United States Patent [19]

Bittings

[11] 4,364,903

[45] Dec. 21, 1982

[54] CONTAMINATION-FREE SEPARATION DEVICE

[75] Inventor: Gilbert S. Bittings, Baltimore, Md.

[73] Assignee: Becton, Dickinson and Company, Paramus, N.J.

[21] Appl. No.: 250,507

[22] Filed: Apr. 2, 1981

[51] Int. Cl.[3] ..... B01L 11/00; B01L 3/00; B04B 9/12

[52] U.S. Cl. ..... 422/101; 422/72; 422/102; 215/247; 215/355; 210/514; 210/DIG. 24

[58] Field of Search ..... 422/101, 102, 72; 233/26; 210/514, DIG. 24; 495/296; 215/247, 355; 220/306, 307; 128/272, 218 NV, 218 M, 218 D

[56] References Cited

U.S. PATENT DOCUMENTS

| | | | |
|---|---|---|---|
| 2,649,245 | 8/1953 | Silverstolpe | 210/DIG. 24 |
| 3,875,012 | 4/1975 | Dorn et al. | 435/296 |
| 4,293,078 | 10/1981 | Percarpio et al. | 215/355 |

*Primary Examiner*—Frank W. Lutter
*Assistant Examiner*—Chris Konkol

[57] ABSTRACT

An arrangement of separation device is provided such that after centrifugation, for example, the heavy materials at the bottom of the separation container may be directly removed from the bottom without first having to decant or otherwise remove the lighter fraction at the upper end of the container. The arrangement may include, for example, a conventional tube-type container modified to have an opening in the bottom. A specially configured plug or stopper is utilized in combination with the container bottom opening to seal the opening closed, which plug is configured to complete the bottom end of the container and to provide an access septum for needle penetration in the bottom of the container. The arrangement of the plug prevents displacement thereof, once it is properly positioned, and includes specifically, a locking detent to prevent the plug from being displaced inwardly upon insertion of a needle into the plug.

4 Claims, 2 Drawing Figures

FIG.1
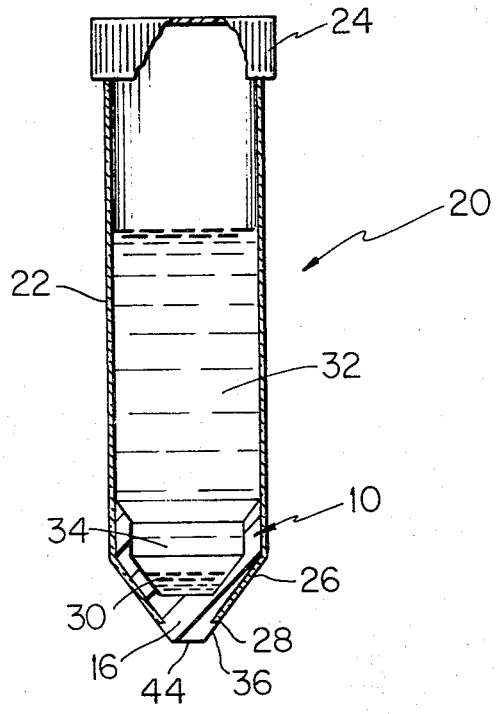
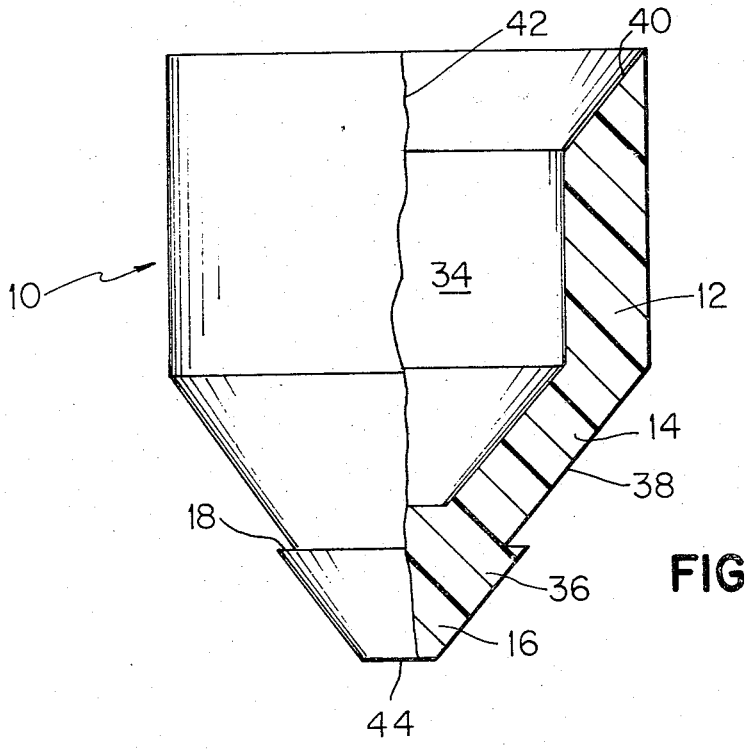
FIG. 2

CONTAMINATION-FREE SEPARATION DEVICE

BACKGROUND AND STATEMENT OF THE INVENTION

Generally speaking, this invention relates to a sample collection device, such as a sputum tube, useful for separating a sample to be examined into a heavy fraction and a light fraction. More particularly, this invention relates to a centrifuge sample collection tube which provides rapid access with less contamination to the heavy fraction at the bottom of the tube, without having to disturb or otherwise expose the upper lighter fraction in the tube. The device of the invention may be a conventional collection tube, modified by having an opening made therein at the bottom for receiving the second portion of the device of the invention here in the form of a plug. The plug is configured to be received into the opening in the bottom of the tube, and to complete or otherwise fill in the outline of the bottom of the tube left by the modified opening. The plug is configured, also, to be held in the bottom of the tube against displacement into or out of the opening, once it is correctly positioned in the opening.

The plug, in accordance herewith, has an annular generally vertical wall defining a central cavity for receiving the heavy fraction during the separation procedure, as described above. In addition, the plug includes an annular notch adjacent the bottom area of the plug for holding the plug against displacement inwardly. The arrangement of the plug is such that it provides a septum area for inserting a needle for removal of the heavy fraction contained in the central cavity, once centrifugation has taken place. Thus, the heavy fraction may be removed by insertion of a needle with syringe without disturbing or otherwise contaminating the upper fraction. It will be understood, further, that the upper fraction will not be exposed to contaminate the hands and/or syringe in such a removal process which would ordinarily be the case if the upper lighter fraction had to be decanted or otherwise removed prior to gaining access to the heavy fraction in the bottom of the tube, after centrifugation.

Other objects and advantages of this invention will now be apparent from the following description, the accompanying drawings, and the appended claims.

DESCRIPTION OF THE DRAWINGS

FIG. 1 is a verticle view in section of a modified sputum collection tube illustrating the invention; and FIG. 2 is an enlarged elevational view partially in section of a portion of the device shown in FIG. 1 illustrating in detail the plug arrangement of the invention.

DETAILED DESCRIPTION OF THE INVENTION

Referring to the drawings in which like reference characters refer to like parts throughout the several views thereof, 20 is a conventional sputum tube such as a Falcon Model 2070 manufactured by Becton Dickinson Labware, Oxnard, Calif. Such tubes may be used, for example, to collect a sputum sample for a TB test wherein sodium hydroxide is added to the collected sputum sample to digest the cells thereof, except the waxy tuberculosis cells. Subsequently, the tube is placed in a centrifuge for separation of the heavy waxy TB cell fraction from the lighter fraction in the sputum sample. In the past, with such an arrangement, it was necessary to remove the cap 24 from the tube 22 and decant the lighter fraction 32, as shown in FIG. 1 so as to obtain the heavier pellet 30 in the bottom of the tube, for subsequent testing procedures.

With this invention, by contrast, such a procedure is not necessary since one need only insert a needle through the septum portion 16 of the plug 10 in the bottom of tube 22 to obtain access to pellet 30 and withdraw it from the tube. Thus, the handler need not contaminate his hands or the syringe in the process of obtaining the pellet 30 from the bottom of tube 20.

A conventional tube 20 is modified to have an opening 28 in the bottom thereof. For a conventionally sized 10 ml. tube, for example, the opening may be, for example, 0.10 inches in diameter. For a 50 ml. tube, the opening may be 0.375 inches, for example. As shown in FIG. 1, sputum collection tube 20 has a tubular wall 22 and a cap 24 for closing the top thereof. With the opening 28 in the bottom thereof, a plug 10 may be inserted. As is shown in FIG. 1, the surface 36 of plug 10, once inserted, restores the profile of the tube angular lower wall 26 except for the flat bottom surface 44, which provides the septum area 16 for insertion of a needle.

Referring now to FIG. 2, plug 10 is shown enlarged. Plug 10 has annular verticle upper wall 12 with an integral converging lower wall 14. Integral with the converging wall 14 is a septum portion 16 which has, as discussed above, a converging annular surface 36 which restores most of the profile of angled wall area 26 of tube 20.

As can be seen in FIG. 2, surface 38 of converging portion 14 of plug 10 is offset from surface 36 of the septum portion 16 of plug 10. This offsetting defines a locking abutment 18, the upper surface of which receives the lower edge of tube wall 26 defining opening 28 for holding plug 10 against displacement in tube 20. Thus, upon insertion of a needle through septum portion 16, locking abutment 18 prevents movement of plug 10 inwardly into tube 20.

As can be seen further in FIG. 2, annular walls 12 and 14 of plug 10 define an internal cavity 34 for receiving the heavy fraction during centrifugation. Moreover, the upper surface 40 of annular wall 12 of plug 10 is angled, as shown in FIG. 2 to diverge away from axis 42 of plug 10. With this arrangement, during centrifugation, the forces acting against surface 40 will force walls 12 and 14 against the corresponding internal surfaces of tube 20 in direct proportion to the pressure generated against surface 40, for example, the pressure developed in a 10 ml. tube at 2500 revolutions per minute (rpm) is around 15 pounds per square inch (psi).

Thus, as will be appreciated from the above description, the invention provides a quicker and less hazardous access to the bottom or heavier fraction in a sputum collection sample tube, for example, which has been centrifuged after a standard digested protocol. The sample layer desired is not disturbed by a decantation procedure of the digested lighter fraction by the disorientation of the tube during the decanting procedure. The heavier fraction and sample desired may be removed by perforating the rubber septum 16 of plug 10, in accordance herewith, with a standard 9.5 mm needle and syringe, thus eliminating the need to extract the pellet from the top which has the disadvantage of contaminating the hands of the operator and the syringe in the process of decantation. The tube and remaining contents, as will be understood, may then be disposed of without opening or further handling.

As will be appreciated, further, the plug arrangement, in accordance herewith for closing the opening in the collection tube, is so arranged that it restores the profile of the tube angle initially. Moreover, the walls of the cup formed by the plug arrangement, once it is inserted in the bottom of the tube, increases the seal between the plug cup and the tube wall directly proportional to an increase in internal pressure during a centrifugation procedure.

While the forms of apparatus herein described constitute preferred embodiments of the invention, it is to be understood that the invention is not limited to these precise forms of apparatus, and changes may be made therein without departing from the scope of the invention which is defined in the appended claims.

What is claimed is:

1. Apparatus for securing the heavy fraction from a separation tube without disturbing the lighter fraction, characterized by (a) a tube body having a top opening and a bottom opening;

(b) said tube body having an annular vertical first wall portion;

(c) a second wall portion integral with said first wall portion;

(d) said second wall portion converging from the bottom edge of said first wall portion to said bottom opening;

(e) a plug for said tube bottom opening extending through said bottom opening;

(f) said plug comprising (1) an annular upper wall portion the top surface of said annular upper wall portion diverging from the outer surface of said upper wall portion toward the axis of said plug;

(2) an annular lower wall portion integral with said upper wall portion and converging downwardly from said upper wall portion;

(3) said upper wall portion and said lower wall portion defining a heavy fraction receiving cup in said plug;

(4) a locking detent in said annular lower wall portion for engaging the bottom surface of said tube body second wall portion; and (5) the lower end of said annular lower wall portion defining a needle receiving septum in said plug.

2. The apparatus of claim 1, further characterized by (a) the outer surface of the lower half of said annular lower wall portion of said plug is offset from the upper half outer surface thereof to define said locking detent.

3. The apparatus of claim 1, further characterized by (a) said annular lower wall portion of said plug ends in a planar surface defining said septum area in said plug.

4. The apparatus of claim 1, further characterized by (a) a cap for said top opening.

* * * * *